US011674705B2

(12) United States Patent
Joo et al.

(10) Patent No.: US 11,674,705 B2
(45) Date of Patent: Jun. 13, 2023

(54) AIR CONDITIONER PROVIDING INFORMATION ON TIME AND/OR POWER REQUIRED TO REACH A DESIRED TEMPERATURE AND METHOD FOR CONTROL THEREOF

(71) Applicant: Samsung Electronics Co., Ltd., Suwon-si (KR)

(72) Inventors: Youngju Joo, Suwon-si (KR); Jun Hwang, Suwon-si (KR); Heechan Kang, Suwon-si (KR); Minkyong Kim, Suwon-si (KR); Kwangil Nam, Suwon-si (KR); Jeonguk Park, Suwon-si (KR); Hyeongjoon Seo, Suwon-si (KR); Hyunwoo Ock, Suwon-si (KR); Sangwoo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 221 days.

(21) Appl. No.: 16/286,000

(22) Filed: Feb. 26, 2019

(65) Prior Publication Data

US 2019/0271483 A1 Sep. 5, 2019

(30) Foreign Application Priority Data

Mar. 5, 2018 (KR) ..... 10-2018-0025915

(51) Int. Cl.
*F24F 11/64* (2018.01)
*F24F 11/52* (2018.01)
(Continued)

(52) U.S. Cl.
CPC ..... *F24F 11/64* (2018.01); *F24F 11/52* (2018.01); *F24F 11/80* (2018.01);
(Continued)

(58) Field of Classification Search
CPC .. F24F 11/52; F24F 11/61; F24F 11/63; F24F 11/64; F24F 11/70; F24F 11/80;
(Continued)

(56) References Cited

U.S. PATENT DOCUMENTS 5,228,306 A * 7/1993 Shyu ..... F24F 11/72 62/262
8,457,933 B2 6/2013 Yoo et al.
(Continued)

FOREIGN PATENT DOCUMENTS

CN 104197468 A 12/2014
CN 105473354 A 4/2016
(Continued)

OTHER PUBLICATIONS

Merriam-Webster Online Dictionary: Definition of Guide (retrieved Oct. 19, 2021 from https://www.merriam-webster.com/dictionary/guide).*
(Continued)

*Primary Examiner* — Jerry-Daryl Fletcher
*Assistant Examiner* — Daniel C Comings
(74) *Attorney, Agent, or Firm* — Jefferson IP Law, LLP

(57) ABSTRACT

An air conditioner is provided. The air conditioner includes a display, a storage configured to store power consumption information and time information which are required to increase or decrease an indoor temperature by a unit temperature according to an outdoor temperature, a sensor, and a processor configured to predict, based on a desired temperature being input, at least one of a power consumption or a required time for the indoor temperature to reach the desired temperature by the sensor based on information stored in the storage, and provide at least one of the predicted power consumption or the required time through the display.

9 Claims, 13 Drawing Sheets

(51) Int. Cl.

| | |
|---|---|
| ***F24F 11/80*** | (2018.01) |
| *F24F 140/60* | (2018.01) |
| *F24F 110/10* | (2018.01) |
| *F24F 130/20* | (2018.01) |
| *F24F 130/30* | (2018.01) |

(52) U.S. Cl.
CPC ..... *F24F 2110/10* (2018.01); *F24F 2130/20* (2018.01); *F24F 2130/30* (2018.01); *F24F 2140/60* (2018.01); *F25B 2500/19* (2013.01); *F25B 2700/15* (2013.01)

(58) Field of Classification Search
CPC ..... F24F 2110/00; F24F 2130/20; F24F 2140/60; F25B 2600/01; F25B 2700/15
USPC ..... 706/16, 21, 902, 903, 904
See application file for complete search history.

(56) References Cited

U.S. PATENT DOCUMENTS

| | | | | |
|---|---|---|---|---|
| 9,209,652 | B2 * | 12/2015 | Imes | G05D 23/1905 |
| 9,429,962 | B2 * | 8/2016 | Matsuoka | G05D 23/1917 |
| 2003/0094006 | A1 * | 5/2003 | Des Champs | H05K 7/206 62/186 |
| 2012/0125559 | A1 | 5/2012 | Fadell et al. | |
| 2012/0131504 | A1 * | 5/2012 | Fadell | F24D 19/1084 715/810 |
| 2014/0316584 | A1 | 10/2014 | Matsuoka et al. | |
| 2015/0018979 | A1 * | 1/2015 | Tomii | H04L 12/2803 700/19 |
| 2015/0369503 | A1 * | 12/2015 | Flaherty | F24F 11/30 700/277 |
| 2016/0054019 | A1 | 2/2016 | Lee et al. | |
| 2016/0054021 | A1 * | 2/2016 | Lee | F24F 11/62 700/276 |
| 2016/0364313 | A1 * | 12/2016 | Roth | G06F 11/3062 |
| 2018/0023834 | A1 * | 1/2018 | Hatch | H04L 12/4625 700/278 |
| 2018/0119973 | A1 * | 5/2018 | Rothman | F24F 11/30 |
| 2018/0195752 | A1 | 7/2018 | Sasaki et al. | |
| 2018/0283723 | A1 | 10/2018 | Ock et al. | |

FOREIGN PATENT DOCUMENTS

| | | | |
|---|---|---|---|
| EP | 3 021 184 | A1 | 5/2016 |
| JP | 2010-091228 | A | 4/2010 |
| JP | 5492670 | B2 | 5/2014 |
| JP | 2016-532355 | A | 10/2016 |
| JP | 2016-194375 | A | 11/2016 |
| JP | 2017-067427 | A | 4/2017 |
| KR | 10-1997-062570 | A | 9/1997 |
| KR | 10-0830095 | B1 | 5/2008 |
| KR | 10-1748661 | B1 | 6/2017 |
| KR | 10-1757446 | B1 | 7/2017 |
| KR | 10-2018-0011672 | A | 2/2018 |
| KR | 10-2018-0112653 | A | 10/2018 |
| WO | 2015/025317 | A1 | 2/2015 |
| WO | 2017/062896 | A1 | 4/2017 |

OTHER PUBLICATIONS

International Search Report dated Jun. 11, 2019, issued in International Patent Application No. PCT/KR2019/002190.
Li Yang, Green Building Design: Building Energy Efficiency, Tongji University Press, Oct. 31, 2016.
Chinese Office Action dated Jul. 23, 2021, issued in Chinese Patent Application No. 201980017259.8.
European Search Report dated Jan. 29, 2021, issued in European Application No. 19764443.8-1008 / 3721148.
Korean Office Action dated Apr. 4, 2022, issued in Korean Patent Application No. 10-2018-0025915.
European Office Action dated Nov. 3, 2022, issued in European Patent Application No. 19764443.8-1016.

* cited by examiner

FIG. 4B

| OUTDOOR TEMPERATURE / INDOOR TEMPERATURE | 30℃ OR BELOW | | 30~35℃ | | 35~40℃ | | 40~45℃ | | 45℃ | |
|---|---|---|---|---|---|---|---|---|---|---|
| | Sec/℃ | Whr/℃ | Sec/℃ | Whr/℃ | Sec/℃ | Whr/℃ | Sec/℃ | Whr/℃ | Sec/℃ | Whr/℃ |
| 20℃ OR BELOW | 90 | 114 | 90 | 114 | 90 | 114 | 90 | 114 | 90 | 114 |
| 20 ~ 22℃ | 90 | 114 | 90 | 114 | 90 | 114 | 90 | 114 | 90 | 114 |
| 22 ~ 24℃ | 90 | 114 | 90 | 114 | 90 | 114 | 90 | 114 | 90 | 114 |
| 24 ~ 26℃ | 122 | 114 | 90 | 114 | 85 | 114 | 120 | 114 | 90 | 114 |
| 26 ~ 28℃ | 102 | 114 | 90 | 114 | 62 | 114 | 110 | 114 | 90 | 114 |
| 28 ~ 30℃ | 135 | 114 | 90 | 114 | 57 | 114 | 97 | 114 | 90 | 114 |
| 30 ~ 32℃ | 90 | 114 | 90 | 114 | 55 | 114 | 78 | 114 | 90 | 114 |
| 32 ~ 34℃ | 90 | 114 | 90 | 114 | 62 | 114 | 67 | 114 | 90 | 114 |
| 36 ~ 38℃ | 90 | 114 | 90 | 114 | 125 | 114 | 60 | 114 | 90 | 114 |
| 38℃ OR HIGHER | 90 | 114 | 90 | 114 | 90 | 114 | 64 | 114 | 90 | 114 |

FIG. 5

| FACTORS | DESCRIPTION |
|---|---|
| INDOOR TEMPERATURE | INDOOR TEMPERATURE WHERE AIR CONDITIONER IS DISPOSED |
| INDOOR HUMIDITY | INDOOR HUMIDITY WHERE AIR CONDITIONER IS DISPOSED |
| AREA | INFORMATION TO OBTAIN OUTDOOR TEMPERATURE/HUMIDITY |
| OUTDOOR TEMPERATURE | OUTDOOR TEMPERATURE WHERE AIR CONDITIONER IS DISPOSED |
| OUTDOOR HUMIDITY | OUTDOOR HUMIDITY WHERE AIR CONDITIONER IS DISPOSED |
| CURRENT MODE | MODE SET BY USER |
| INDOOR TEMPERATURE – DESIRED TEMPERATURE | DIFFERENCE BETWEEN INDOOR TEMPERATURE AND DESIRED TEMPERATURE |

AIR CONDITIONER PROVIDING INFORMATION ON TIME AND/OR POWER REQUIRED TO REACH A DESIRED TEMPERATURE AND METHOD FOR CONTROL THEREOF

CROSS-REFERENCE TO RELATED APPLICATION(S)

This application is based on and claims priority under 35 U.S.C. § 119(a) of a Korean patent application number 10-2018-0025915, filed on Mar. 5, 2018, in the Korean Intellectual Property Office, the disclosure of which is incorporated by reference herein in its entirety.

BACKGROUND

1. Field

The disclosure relates to an air conditioner and control methods. More particularly, the disclosure relates to an air conditioner and a control method thereof for providing information on an indoor temperature and a desired temperature and a controlling method thereof.

In addition, the disclosure relates to an artificial intelligence (AI) system and its application that simulate functions such as recognition and judgment of a human brain using a machine learning algorithm.

2. Description of Related Art

In recent years, AI systems that implement human intelligence have been used in various fields. An AI system is a system that the machine learns, judges and becomes smart, unlike the existing rule-based smart system. As the use of AI systems improves recognition rate and understanding of user's taste more accurately, existing rule-based smart systems are gradually being replaced by deep learning-based artificial intelligence systems.

AI technology is composed of machine learning (for example, deep learning) and elementary technologies which utilizes machine learning.

Machine learning is an algorithm technology that classifies/learns the characteristics of input data by itself. Element technology is a technology that simulates functions such as recognition and judgment of human brain using machine learning algorithms such as deep learning. Machine learning is composed of technical fields such as linguistic understanding, visual understanding, reasoning/prediction, knowledge representation, motion control, etc.

Various fields in which AI technology is applied are as follows. Linguistic understanding is a technology for recognizing, applying/processing human language/characters and includes natural language processing, machine translation, dialogue system, question & answer, speech recognition/synthesis, and the like. Visual understanding is a technique for recognizing and processing objects as human vision, including object recognition, object tracking, image search, human recognition, scene understanding, spatial understanding, image enhancement, and the like. Inference prediction is a technique for judging and logically inferring and predicting information, including knowledge/probability based inference, optimization prediction, preference-based planning, and recommendation. Knowledge representation is a technology for automating human experience information into knowledge data, including knowledge building (data generation/classification) and knowledge management (data utilization). The motion control is a technique for controlling the autonomous running of the vehicle and the motion of the robot, including motion control (navigation, collision, driving), operation control (behavior control), and the like.

In recent years, air conditioners for maintaining a comfortable indoor environment by controlling the temperature, humidity, cleanliness and air flow of the indoor space have been widely used.

The air conditioner provides the user only with information on the current indoor temperature and the desired temperature and information on the cumulative usage amount at the time when the operation of the air conditioner is terminated.

Accordingly, there is a problem that a user cannot confirm information about the time required for the indoor temperature to reach the desired temperature or the amount of power consumption at the initial stage of driving the air conditioner.

Accordingly, a user can only adjust the desired temperature depending on the temperature change directly sensed or the change in the indoor temperature provided through the display of the air conditioner. Therefore, there was a problem that energy consumption of the air conditioner becomes excessive.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device which provides a user with information on time and power that are required for indoor temperature to reach desired temperature and controlling methods thereof.

Another aspect of the disclosure is to provide an air conditioner which includes a display, a storage configured to store power consumption information and time information which are required to increase or decrease indoor temperature by a unit temperature according to outdoor temperature, a sensor, and a processor configured to, based on desired temperature being input, predict at least one of power consumption and time required for indoor temperature to reach the desired temperature by the sensor based on information stored in the storage, and provide at least one of the predicted power consumption and time through the display.

Additional aspects will be set forth in part in the description which follows and, in part, will be apparent from the description, or may be learned by practice of the presented embodiments.

In accordance with an aspect of the disclosure, an air conditioner is provided. The air conditioner includes a communication unit, and the processor may receive, through the communication unit, information on outdoor temperature of an area in which the air conditioner is disposed, and predict at least one of power consumption and time required to reach the desired temperature based on the received outdoor temperature and the sensed indoor temperature.

The processor may, based on indoor temperature sensed through the sensor being increased or decreased by a preset unit temperature, obtain power consumption and required time which are consumed by the air conditioner so that the indoor temperature increases or decreases by the unit temperature, and update the stored information based on at least one of the obtained power consumption and required time.

The processor may predict an indoor environment in which the air conditioner is disposed based on the obtained power consumption and required time, obtain power consumption information and time information corresponding to the predicted indoor environment, and store the same in the storage, wherein the indoor environment may include at least one of a size, a degree of lighting, and humidity of an indoor space in which the air conditioner is disposed.

The processor may, based on the indoor temperature sensed through the sensor being increased or decreased by a predetermined unit temperature, obtain power consumption and required time which the air conditioner consumes to increase or decrease the indoor temperature, compare at least one of the obtained power consumption and required time with at least one of the stored power consumption information and time information, and provide a feedback according to a comparison result.

The processor may, based on the comparison result exceeding a predetermined error range, provide a guide on the indoor environment in which the air conditioner is positioned.

The storage may store a use history including at least one of an operation mode of the air conditioner by the sensed indoor temperature and desired temperature, and wherein the processor may obtain a preferred mode and a preferred temperature of a user based on the use history, and predict at least one of power consumption and time which are required for the sensed indoor temperature to reach the preferred temperature in the preferred mode.

The processor may, based on a present time, obtain a preferred mode and preferred temperature of the user preferred at the present time.

The processor may predict at least one of the power consumption and the time through an artificial intelligence (AI) model, wherein the AI model is a model that is learned based on at least one of the power consumption information, the time information, and an indoor environment in which the air conditioner is disposed, and wherein the indoor environment may include at least one of a size, a degree of lighting, and humidity of an indoor space in which the air conditioner is disposed.

The processor may, if a difference between the sensed indoor temperature and the desired temperature is greater than or equal to a predetermined value, set the air conditioner to a first mode, and predict at least one of power consumption and time which are required for the sensed indoor temperature to reach the desired temperature based on an air conditioning function in the first mode, and if a difference between the sensed indoor temperature and the desired temperature is less than a predetermined value, set the air conditioner to a second mode, and predict at least one of power consumption and time which are required for the sensed indoor temperature to reach the desired temperature based on an air conditioning function in the second mode.

The processor may, based on the sensed indoor temperature reaching the desired temperature, provide accumulated power consumption through the display.

In accordance with another aspect of the disclosure, a controlling method of an air conditioner is provided. The controlling method of an air conditioner in which power consumption information and time information which are required to increase or decrease indoor temperature by a unit temperature according to outdoor temperature includes sensing indoor temperature, based on desired temperature being input, predicting at least one of power consumption and time required for indoor temperature to reach the desired temperature by the sensor based on information stored in the storage, and outputting at least one of the predicted power consumption and time.

The method may include receiving information on outdoor temperature of an area in which the air conditioner is disposed, wherein the predicting may include predicting at least one of power consumption and time required to reach the desired temperature based on the received outdoor temperature and the sensed indoor temperature.

The method may include, based on indoor temperature sensed through the sensor being increased or decreased by a preset unit temperature, obtaining power consumption and required time which are consumed by the air conditioner so that the indoor temperature increases or decreases by the unit temperature, and updating the stored information based on at least one of the obtained power consumption and required time.

The method may include predicting an indoor environment in which the air conditioner is disposed based on the obtained power consumption and required time, obtaining power consumption information and time information corresponding to the predicted indoor environment, and storing the same, wherein the indoor environment may include at least one of a size, a degree of lighting, and humidity of an indoor space in which the air conditioner is disposed.

The method may include, based on the indoor temperature sensed through the sensor being increased or decreased by a predetermined unit temperature, obtaining power consumption and required time which the air conditioner consumes to increase or decrease the indoor temperature, comparing at least one of the obtained power consumption and required time with at least one of the stored power consumption information and time information, and providing a feedback according to a comparison result.

The method may include, based on the comparison result exceeding a predetermined error range, providing a guide on the indoor environment in which the air conditioner is positioned.

The storage may store a use history including at least one of an operation mode of the air conditioner by the sensed indoor temperature and desired temperature, and the method may further include obtaining a preferred mode and a preferred temperature of a user based on the use history, and the predicting may include predicting at least one of power consumption and time which are required for the sensed indoor temperature to reach the preferred temperature in the preferred mode.

The obtaining may include, based on a present time, obtaining a preferred mode and preferred temperature of the user preferred at the present time.

The predicting may include predicting at least one of the power consumption and the time through an AI model, wherein the AI model is a model that is learned based on at least one of the power consumption information, the time information, and an indoor environment in which the air conditioner is disposed, and wherein the indoor environment may include at least one of a size, a degree of lighting, and humidity of an indoor space in which the air conditioner is disposed.

According to various embodiments as described above, a user can be provided with information to predict remaining time or estimated power consumption until indoor environment reaches a pleasant environment at an early stage of driving of an air conditioner.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 4B is a view to describe information on power consumption and required time according to an embodiment of the disclosure;

FIG. 5 is a view to describe information obtained by an air conditioner according to another embodiment of the disclosure;

Throughout the drawings, like reference numerals will be understood to refer to like parts, components, and structures.

DETAILED DESCRIPTION

Figure 1:
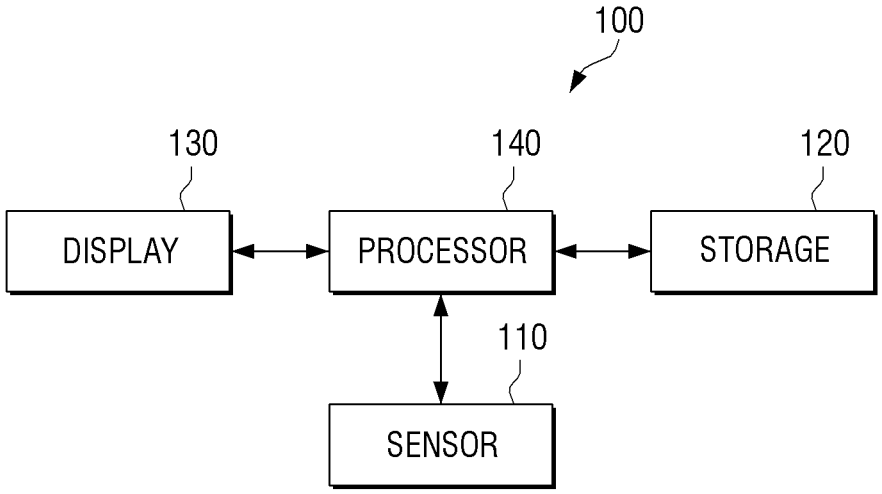
FIG. 1 is a block diagram to describe an air conditioner according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As embodiments may have a variety of modifications and several examples, certain embodiments will be exemplified in the drawings and described in detail in the description thereof. However, this does not necessarily limit the scope of the embodiments to a specific embodiment form. Instead, modifications, equivalents and replacements included in the disclosed concept and technical scope of this specification may be employed. While describing embodiments, if it is determined that the specific description regarding a known technology obscures the gist of the disclosure, the specific description is omitted.

In the disclosure, relational terms such as first and second, and the like, may be used to distinguish one entity from another entity, without necessarily implying any actual relationship or order between such entities. In embodiments of the disclosure, relational terms such as first and second, and the like, may be used to distinguish one entity from another entity, without necessarily implying any actual relationship or order between such entities.

The terms "include," "comprise," "is configured to," etc., of the description are used to indicate that there are features, numbers, operations, elements, parts or combination thereof, and they should not exclude the possibilities of combination or addition of one or more features, numbers, operations, elements, parts or a combination thereof.

According to embodiments, a "module" or "unit" performs at least one function or operation, and may be implemented as hardware or software, or a combination of hardware and software. In addition, a plurality of 'modules' or a plurality of 'units' may be integrated into at least one module and may be realized as at least one processor except for 'modules' or 'units' that should be realized in a specific hardware.

FIG. 1 is a block diagram to describe an air conditioner according to an embodiment of the disclosure.

Referring to FIG. 1, the air conditioner 100 includes a sensor 110, a storage unit 120, a display 130, and a processor 140.

The air conditioner 100 according to an embodiment of the disclosure is an air conditioner and an air conditioner, which means various types of apparatuses that keep a room pleasant by heating, cooling, humidity control, humidification, ventilation, and so on. For example, the air conditioner 100 may be implemented as an air conditioning device which can serve as a heater, an air conditioner capable of both heating and cooling. However, the disclosure is not limited thereto, and the air conditioner 100 may be implemented by various types of apparatuses capable of increasing or decreasing an indoor temperature, and the disclosure can be applied to an apparatus that is capable of only cooling or heating. Hereinafter, for convenience of explanation, the air conditioner 100 is assumed to be an air conditioner capable of both cooling and heating.

The air conditioner 100 according to an embodiment of the disclosure may include an indoor unit and an outdoor unit. The indoor unit is connected to the outdoor unit, and the indoor unit exchanges a refrigerant with the outdoor unit through the piping. The air conditioner 100 including the indoor unit and the outdoor unit may include various operation modes such as cooling for lowering the temperature of the indoor air, heating for raising the temperature of the indoor air, ventilation for forming air current in a room, and dehumidification for lowering indoor humidity, and the like. The operation mode of the air conditioner 100 will be described later.

The outdoor unit according to an embodiment of the disclosure exchanges heat with outside air. The outdoor unit can exchange heat with outside air through a cooling cycle that discharges heat transferred from the indoor unit through the refrigerant to the outside, or can exchange heat with the outside air through a heating cycle in which heat absorbed from the outside is absorbed by the refrigerant. The outdoor unit includes a compressor for compressing the refrigerant. The compressor may be implemented in any one of a constant speed type, a step type (or twin power cooling system (TPS)), and an inverter type. Constant-speed type is a type in which the driving of the compressor is controlled on/off in accordance with the cooling/heating load. The step type includes a plurality of compressors and controls the number of compressors to be driven in accordance with the cooling/heating load. The inverter type is a control type that linearly increases or decreases the driving ability of the compressor according to the cooling/heating load.

The sensor 110 may sense ambient air information of the air conditioner 100. Here, the ambient air information may include various information such as indoor temperature, room humidity, room air volume, etc., as information related to the room air in which the air conditioner 100 is disposed. However, the disclosure is not limited thereto, and the sensor 110 may be provided in the indoor unit to sense the indoor temperature, and may be provided in the outdoor unit to sense the outdoor temperature. The sensor 110 may include a temperature sensor for sensing the temperature, an air speed sensor for sensing the wind speed of the room, a humidity sensor for sensing the humidity of the air, and the like.

The storage unit 120 may store power consumption information and time information required to increase or decrease the indoor temperature by the unit temperature according to the outdoor temperature.

Here, the outdoor temperature means the outdoor air temperature of an area where the air conditioner 100 is disposed. For example, the outdoor temperature may mean an initial temperature sensed through the outdoor unit included in the air conditioner 100. As another example, it is of course possible to receive, from the server, information on the outdoor temperature of the area in which the air conditioner 100 is disposed. Information on power consumption and required time for increasing and decreasing indoor temperature by unit temperature is different according to outdoor temperature, and the storage unit 120 may store information power consumption and required time consumed to increase and decrease indoor temperature by unit temperature by outdoor temperatures. For example, the storage unit 120 may store information on power consumption and time to reduce indoor temperature by 1 degree Celsius when outdoor temperature is 30 degrees Celsius and indoor temperature is 29 degrees Celsius, and when outdoor temperature is 35 degrees Celsius and indoor temperature is 29 degrees Celsius.

The storage unit 120 according to an embodiment may store power consumption information and time information required to increase and decrease the indoor temperature by a unit temperature according to the operation mode, the outdoor temperature, the indoor humidity, and the size of the space in which the air conditioner 100 is disposed.

The storage unit 120 according to an embodiment of the disclosure may store the usage history of the user. For example, the storage unit 120 may store a usage history including at least one of an operation mode and a desired temperature of the air conditioner 100 set by the user. Here, the desired temperature means an indoor temperature to be reached by operating the air conditioner 100, and may be called a set temperature.

In particular, the storage unit 120 according to an embodiment may store at least one of the operating mode and the desired temperature of the air conditioner 100 sensed through the sensor 110 by the indoor temperature as a usage history. Since the operation mode and the desired temperature set by the user may be different according to the indoor temperature, the operation mode and the desired temperature can be stored according to the indoor temperature. For example, the air conditioner 100 may store the usage history of the user such as the dehumidification mode at the indoor temperature of 25 degrees Celsius in the operation mode and 24 degrees Celsius as the desired temperature in the storage unit 120.

The display 130 may be implemented with various types of displays such as an organic light emitting diode (OLED), a seven-segment display, and the like.

The display 130 according to an embodiment of the disclosure may display various information about the air conditioner 100. In particular, the display 130 may display at least one of the ambient air information and operating state of the air conditioner 100, such as outdoor temperature, indoor temperature, desired temperature, and operating mode.

In particular, the display 130 may display the power consumption and time required for the indoor temperature to reach the desired temperature. A detailed description thereof will be given in the processor 140.

The processor 140 controls the operation of the air conditioner 100 as a whole.

According to an embodiment, the processor 140 may be implemented as a digital signal processor (DSP), a microprocessor, a time controller (TCON), etc. However, the disclosure is not limited thereto, and may include or be defined as a central processing unit (CPU), a microcontroller unit (MCU), a micro processing unit (MPU), a controller, an application processor (AP), a communication processor (CP), and an ARM processor. The processor 140 may be implemented as a system on chip (SoC), a large scale integration (LSI) with a built-in processing algorithm, or a field programmable gate array (FPGA).

The processor 140 can predict at least one of the power consumption and the time required for the sensed indoor temperature to reach the desired temperature based on the information stored in the storage unit 120, when the desired temperature is input. For example, when the outdoor temperature is 33 degrees Celsius, the processor 140 can predict the power consumption and time required for the indoor temperature to reach the desired temperature of 20 degrees Celsius at the sensed indoor temperature of 30 degrees Celsius.

The processor 140 according to an embodiment of the disclosure may predict at least one of the power consumption and the time required for the indoor temperature sensed through a learned artificial intelligence (AI) model to reach the desired temperature based on the information stored in the storage unit 120. Herein, the AI model may exist in the air conditioner 100, but it may exist in an external server only by way of an embodiment, and the air conditioner 100 may transmit the desired temperature to the external server, predict at least one of power consumption and time required for the indoor temperature to reach the desired temperature using the AI model, and the air conditioner 100 may receive at least one of the power consumption and the time predicted from the external server.

The AI model according to an embodiment of the disclosure may be a model which is learned to predict at least one of power consumption and the time which are required so that indoor temperature reaches desired temperature, using power and time required by the air conditioner 100 for increasing indoor temperature by unit temperature, and indoor environment in which the air conditioner 100 is disposed as input data. Here, the indoor environment may include at least one of the size of the indoor space in which the air conditioner is disposed, the degree of lighting and humidity.

The AI model according to an embodiment may be re-learned by information on power consumption and required time which are obtained by operation of the air conditioner 100.

The processor 140 in accordance with an embodiment of the disclosure may provide predicted power consumption and time through the display 130. Thus, the processor 140 can provide the user with the power and time that the air conditioner 100 is expected to consume until the indoor temperature reaches the desired temperature.

When the indoor temperature is sensed by the sensor 110 to be increased or decreased by a predetermined unit temperature, the processor 140 may identify the power and time which are required by the air conditioner 100 to increase or decrease indoor temperature by the unit temperature. For example, if the indoor temperature is reduced from 29 degrees Celsius to 28 degrees Celsius, the power and time which are required for the air conditioner 100 to reduce the indoor temperature by 1 degree Celsius can be identified.

The processor 140 according to an embodiment of the disclosure differs in power and time required to reduce the indoor temperature by 1 degree Celsius when the outdoor temperature is 35 degrees Celsius and when the outdoor temperature is 28 degrees Celsius, and thus, the processor may identify the power and time consumed to increase or decrease the indoor temperature by the unit temperature.

The processor 140 may update the information stored in the storage unit 120 based on at least one of the identified power consumption and the required time.

The processor 140 according to an embodiment of the disclosure may identify the time required for the indoor temperature to be reduced by a predetermined unit temperature in accordance with the operation of the air conditioner 100, and update the time information prestored in the storage unit 120.

As another example, the processor 140 may identify the consumed power in which the indoor temperature is reduced by a predetermined unit temperature in accordance with the operation of the air conditioner 100, and update information on the power consumption pre-stored in the storage unit 120 based on the identified information.

The AI model according to an embodiment of the disclosure can be re-learned based on updated information. The process of re-learning of the AI model will be described in detail with reference to drawings later.

The processor 140 according to an embodiment, when indoor temperature which is sensed through the sensor 110 increases or decreases by a predetermined unit temperature, may identify consumed power of the air conditioner 100 and required time to increase or decrease the indoor temperature by a unit temperature, and the processor 140, based on the identified power consumption and required time, may predict an indoor environment in which the air conditioner is disposed. For example, the processor 140, based on power consumption and required time to reduce in door temperature from 28 degrees Celsius to 27 degrees Celsius, when outdoor temperature is 35 degrees Celsius, may predict an indoor environment where the air conditioner 100 is disposed. Here, the indoor environment may include at least one of a size of an indoor space, a degree of lighting, and humidity.

Power and time which are required to reduce indoor temperature by 1 degree Celsius may be different by sizes of spaces. For example, the larger the size of the space is, the greater the required power and time comparatively increase, and the smaller the size of the space is, the smaller the required power and time would decrease. The processor 140, based on identified power consumption and required time, may predict a size of an indoor space.

The processor 140 according to an embodiment may acquire power consumption information and time information corresponding to the predicted indoor environment and store the information in the storage unit 120. The AI model according to an embodiment of the disclosure may be a model learned based on power consumption information, time information, and indoor environment. As another example, the AI model can be re-learned based on the obtained information when power consumption information and time information corresponding to the predicted indoor environment are obtained.

The processor 140 according to an embodiment may predict at least one of power consumption and time required for the indoor temperature to reach the desired temperature through the re-learned AI model based on the power consumption information and the time information considering the indoor environment. Accordingly, relatively accurately predicted power consumption and time may be provided through the display 130.

The processor 140 according to an embodiment of the disclosure may compare at least one of the obtained power consumption and the required time with at least one of power consumption information and time information stored in the storage unit 120, and provide feedback according to a comparison result.

In particular, the processor 140 may identify whether the comparison result exceeds a predetermined error range. For example, it is assumed that, when the outdoor temperature is 35 degrees Celsius, if the indoor temperature decreases from 28 degrees Celsius to 27 degrees Celsius, and the time required is 180 seconds (sec), and the time information is 90 sec according to the time information stored in the storage unit 120. Since the processor 140 has taken about twice as much time to reduce the indoor temperature by 1 degree Celsius, the comparison result can be identified as exceeding a predetermined error range.

The processor 140 according to an embodiment may re-predict at least one of the power consumption information and the time information using the AI model. In fact, if the difference between the time spent to reduce the indoor temperature and the predicted time is large, the processor 140 may predict the time information and provide the predicted time information. Here, the processor 140 may sense at least one of the outdoor temperature and the indoor temperature again, and re-predict the time information through the AI model based on the sensed outdoor temperature and the indoor temperature.

As another example, the processor 140 may provide a guide to the indoor environment in which the air conditioner 100 is located if the comparison result is identified as exceeding a predetermined error range. For example, a guide to the indoor environment may include phrases such as "Make sure the windows are open" and "Hang a window with a curtain to control the lighting." If it is identified that at least one of power consumption and required time which are consumed to increase or decrease indoor temperature according to inflow of external air increases greater than or equal to a preset error range, a guide such as "please check whether the windows are open" can be provided.

The processor 140 according to an embodiment of the disclosure can acquire the user's preferred mode and the preferred temperature based on the usage history stored in the storage unit 120. The processor 140 can predict the power consumption and time required for the indoor temperature to reach the preferred temperature on the preferred mode. For example, the processor 140 may obtain a dehumidification mode and a temperature of 21 degrees Celsius, respectively, in the preferred mode and the preferred temperature, respectively, according to the user's usage history. The processor 140 can predict the power consumption and time required for the indoor temperature to reach 21 degrees Celsius in the dehumidification mode.

The power consumption and time which are required to increase and decrease indoor temperature by unit temperature according to an operation mode of the air conditioner 100 are different. The processor 140, based on an operation mode, may predict power consumption and time required so that indoor temperature reaches the desired temperature or preferred temperature.

The usage history according to an embodiment of the disclosure may further include time information when the air conditioner 100 operates. The processor 140 may obtain the preferred mode and the preferred temperature of the user at the current time based on the current time. For example, the processor 140 may acquire "rapid cooling" and "20 degrees Celsius" respectively at 1:00 pm on the user's preferred mode and preferred temperature at 1:00 pm, and "power-saving mode" and "22 degrees Celsius" respectively at 11:00 pm. The processor 140 can operate with the preferred mode and the preferred temperature obtained based on the current time as the operation mode and the desired temperature, respectively, and predict power consumption and time required so that indoor temperature reaches the preferred temperature in the preferred mode.

The processor 140 according to another embodiment of the disclosure can set the air conditioner 100 to a mode optimized for the current time if the current time is within a predetermined time range. For example, the optimized mode of the air conditioner 100 may be preset for each time zone. The processor 140 may set the optimized mode corresponding to the current time to the operating mode.

According to an embodiment, at least one of the sleep mode, the tropical night's pleasant sleep mode, and the power saving mode may be preset to an optimized mode in the time zone from 10:00 pm to 6:00 am on the next day. The processor 140 can set at least one of the sleep mode, the tropical night's pleasant sleep mode, and the power saving mode to the operation mode of the air conditioner 100 if the current time is within the time range from 10 pm to 6 am.

If the difference between the sensed indoor temperature and the desired temperature is equal to or greater than a preset value, the processor 140 according to the embodiment of the disclosure may set the air conditioner to the first mode, and if the difference is less than the preset value, the air conditioner can be set to the second mode. For example, if the difference between the indoor temperature and the desired temperature is 3 degrees Celsius or more, the processor 140 can set the rapid cooling mode. As another example, if the difference between the indoor temperature and the desired temperature is less than 3 degrees Celsius, the processor 140 may set the power saving mode.

According to an embodiment, the processor 140 can estimate the power consumption and time required for the sensed indoor temperature to reach the desired temperature based on the air conditioning performance in the set mode. For example, the air conditioning performance of the air conditioner 100 may differ from one operation mode to another. Since the wind strength and the dehumidification performance in the rapid cooling mode are different from the wind strength and the dehumidification performance in the power saving mode, the processor 140 can predict the power consumption and the time in consideration of the air conditioning performance corresponding to the mode. When the air conditioner 100 is set to the first mode, the processor 140 may estimate power consumption and time based on the air conditioning performance of the first mode, and when the air conditioner 100 is set to the second mode, may predict power consumption and time based on the air conditioning function of the second mode.

The processor 140 according to an embodiment, if indoor temperature sensed through the sensor reaches the desired temperature, may provide accumulated consumption power through the display 130.

The air conditioner 100 according to the embodiment of the disclosure may include a communication unit (not shown). The communication unit is configured to perform communication with various types of external devices according to various types of communication methods. The communication unit includes a Wi-Fi chip, a Bluetooth chip, a wireless communication chip, a near field communication (NFC) chip, and the like.

In particular, the communication unit may receive information on outdoor information of an area where the air conditioner 100 is disposed by performing communication with a server.

The communication unit according to an embodiment may communicate with the server to receive power consumption information and time information. For example, if the power consumption information and the time information are not stored in the storage unit 120, the processor 140 may receive the power consumption information and the time information from the server through the communication unit, and based on the received information, predict power consumption and time. However, the disclosure is not limited thereto, and the processor 140 may receive, from the communication unit, power consumption information and time which are required to increase and decrease indoor temperature by unit temperatures of a space where the air conditioner 100 is disposed by operation modes, outdoor temperatures, indoor humidity, and a size of the space where the air conditioner 100 is disposed.

As another example, the air conditioner 100 may receive the AI model from the server. Herein, the AI model may be a model which is learned based on power consumption information and time information which are required to increase and decrease indoor temperature by unit temperatures by operation modes of the air conditioner 100, outdoor temperatures, indoor humidity, and a size of a space where the air conditioner 100 is disposed. The air conditioner 100 may predict at least one of power consumption and time which are required so that indoor temperature reaches desired temperature using the received AI model.

The communication unit performs communication using a Wi-Fi method and a Bluetooth method, respectively. When a Wi-Fi chip or a Bluetooth chip is used, various connection information such as a service set identifier (SSID) and a session key may be transmitted and received first, and communication information may be used to transmit and receive various information. The wireless communication chip means a chip that performs communication according to various communication standards such as IEEE, zigbee, 3rd generation (3G), 3rd generation partnership project (3GPP), long term evolution (LTE). The NFC chip refers to a chip operating in a NFC mode using 13.56 MHz band among various radio frequency identification (RF-ID) frequency bands such as 135 kHz, 13.56 MHz, 433 MHz, 860 to 960 MHz, 2.45 GHz.

The air conditioner 100 according to another embodiment may include a speaker (not shown). The predicted power consumption and time provided through the display 130 according to various embodiments can be output as a voice signal through a speaker.

Hereinabove, it has been described that the air conditioner 100 decreases indoor temperature according to an embodiment, but application of the disclosure is also available in a case of increasing indoor temperature in a reverse case.

The AI model is a learned determination model based on an AI algorithm, for example, it may be a model based on a neural network. The learned AI model may include a plurality of weighted network nodes that may be designed to simulate the human brain structure on a computer and simulate a neuron of a human neural network. The plurality of network nodes may each establish a connection relationship so that the neurons simulate the synaptic activity of the neurons sending and receiving signals through the synapse. Also, the learned AI model may include, for example, a neural network model or a deep learning model developed from a neural network model. In the deep learning model, a plurality of network nodes are located at different depths (or layers), and may transmit and receive data according to a convolution connection relationship. Examples of learned determination models include, but are not limited to, deep neural network (DNN), recurrent neural network (RNN), and bidirectional recurrent deep neural network (BRDNN).

In addition, the air conditioner 100 may use an AI dedicated program (or an AI agent) for predicting at least one of the power consumption and the time required for the desired temperature. At this time, the AI dedicated program is a dedicated program for providing an AI-based service, and can be executed by a general purpose processor (e.g., a CPU) or a separate AI dedicated processor (e.g., a graphic processing unit (GPU), etc.).

Specifically, when a predetermined user input is input or a button (for example, a button requesting provision of estimated power consumption, an expected time, etc., a button for executing an AI agent) provided on the air conditioner 100 is pressed or desired temperature is input, the AI agent can be operating (or running). In addition, the AI agent may transmit the input desired temperature to an external server, and output at least one of the estimated power consumption and the estimated time received from an external server.

Figure 2:
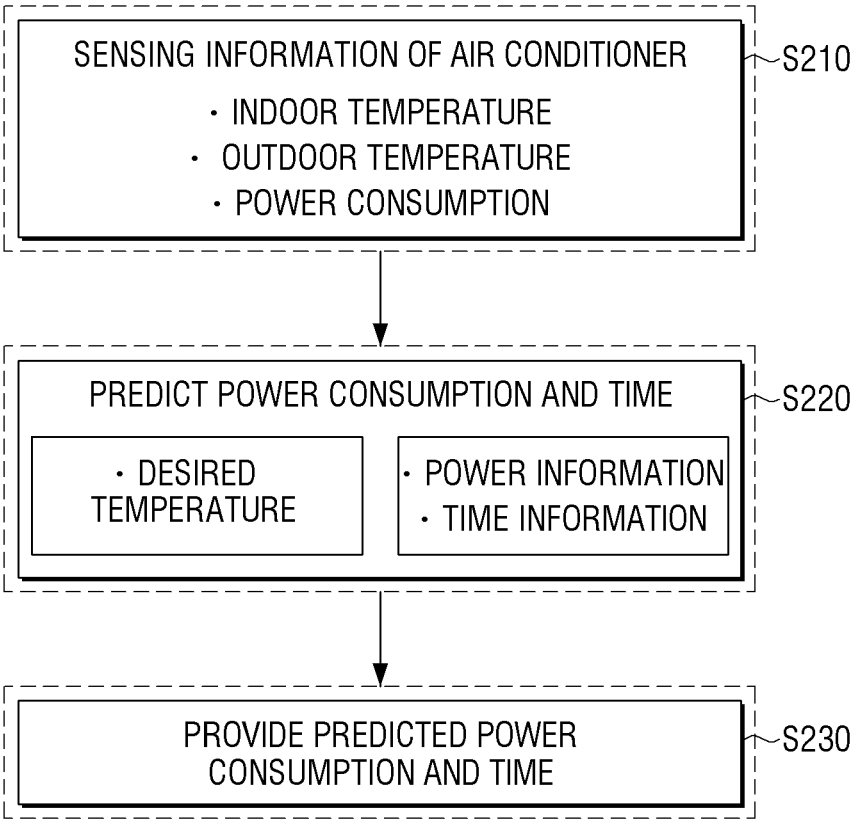
FIG. 2 is a flowchart to describe a method for predicting power consumption and required time according to an embodiment of the disclosure.

FIG. 2 is a flowchart to describe a method for predicting power consumption and required time according to an embodiment of the disclosure.

Referring to FIG. 2, the air conditioner 100 can sense indoor temperature, outdoor temperature, power consumption, and so on in operation S210. However, the disclosure is not limited thereto, and it is needless to say that it is also possible to receive information on the outdoor temperature of the area where the air conditioner 100 is disposed from the server.

The air conditioner 100, based on power consumption information and time information, may predict power consumption and time which are required so that indoor temperature reaches the desired temperature in operation S220.

Then, the air conditioner 100 can provide the predicted power consumption and time in operation S230. The predicted power consumption and time according to an embodiment may be provided through the display. However, the disclosure is not limited thereto, and the air conditioner 100 may output sound through a speaker.

Figure 3:
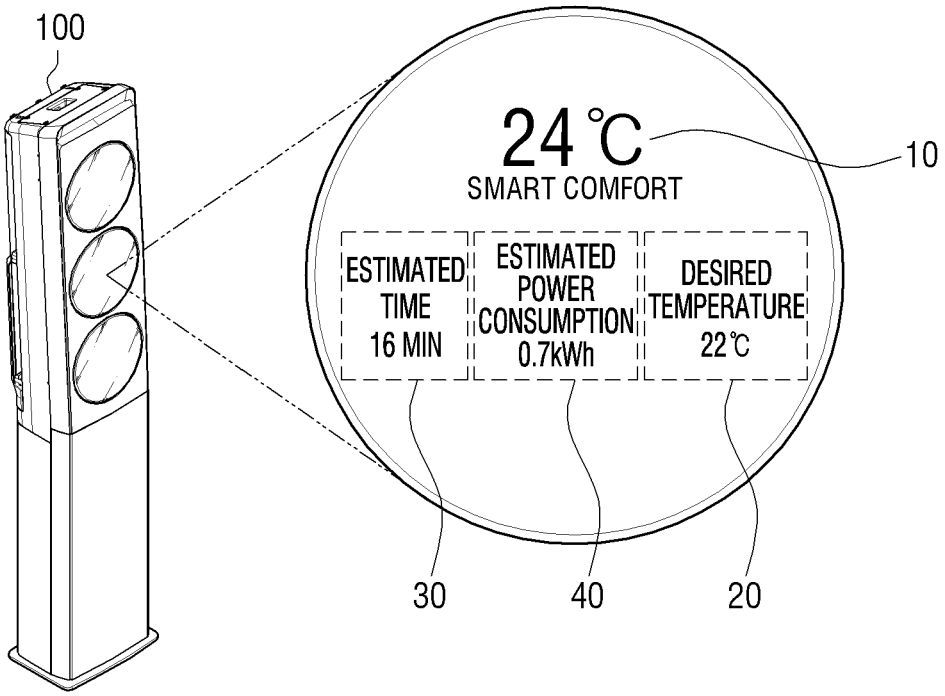
FIG. 3 is a view to describe predicted power consumption and required time according to an embodiment of the disclosure.

FIG. 3 is a view to describe predicted power consumption and required time according to an embodiment of the disclosure.

Referring to FIG. 3, when the indoor temperature 10 is 24 degrees Celsius, the estimated time 30 and estimated power consumption 40 until the indoor temperature 10 reaches the desired temperature 20, which is 22 degrees Celsius, can be displayed.

Since the estimated time 30 and the estimated power consumption 40 required for the indoor temperature 10 to reach the desired temperature 20 are provided to the user, the operation mode suitable for the current indoor temperature 10, and desired temperature 20 may be selected. The power consumption of the air conditioner 100 can be efficiently managed.

Figure 4A:
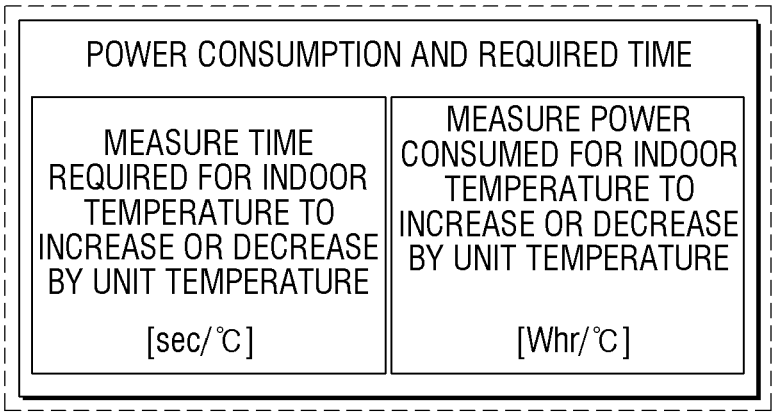
FIG. 4A is a view to describe a method of obtaining information on power consumption and required time according to an embodiment of the disclosure.

FIG. 4A is a view to describe a method of obtaining information on power consumption and required time according to an embodiment of the disclosure.

Referring to FIG. 4A, when the sensed indoor temperature is increased or decreased by a preset unit temperature, the air conditioner 100 may obtain the required time and power consumption which the air conditioner consumed to increase or decrease indoor temperature by the unit temperature.

For example, when the indoor temperature is reduced from 29 degrees Celsius to 28 degrees Celsius at the outdoor temperature of 30 degrees Celsius, the power (Watt-hour (Whr)/degree Celsius) consumed by the air conditioner 100 and the required time (sec/degree Celsius) can be obtained. The air conditioner 100 may store the obtained power consumption and the required time.

FIG. 4B is a view to describe information on power consumption and required time according to an embodiment of the disclosure.

Referring to FIG. 4B, the air conditioner 100 stores a table including power consumption information and time information required to increase and decrease the indoor temperature by the unit temperature according to the outdoor temperature.

For example, it can be known that time 90 sec and power 114 Whr are required so that the indoor temperature is reduced from 24 degrees Celsius to 23 degrees Celsius at the outdoor temperature of 35 degrees Celsius.

The air conditioner 100 according to an embodiment of the disclosure can acquire the power consumed by the air conditioner 100 and the time required for the indoor temperature to be increased or decreased by the unit temperature when an increase or decrease in the indoor temperature is detected. The air conditioner 100 can update the table shown in FIG. 4B based on the obtained power consumption and the required time. Further, as described above, the AI model can be re-learned by using updated tables as input data.

The air conditioner 100 according to the embodiment of the disclosure can predict the power consumption and time required for the indoor temperature to reach the desired temperature based on the table shown in FIG. 4B. For example, if the outdoor temperature is 29 degrees Celsius, the indoor temperature is 29 degrees Celsius, and the desired temperature is 24 degrees Celsius, the air conditioner 100 can predict the required time based on the following Equation 1.

583(sec)=135(sec/degree Celsius)*1(degree Celsius)+102(sec/degree Celsius)*2(degrees Celsius)+122(sec/degree Celsius)*2(degrees Celsius) Equation 1

The air conditioner 100 according to the embodiment can estimate the required time to reach 583 sec, that is, the time required for the indoor temperature to reach 24 degrees Celsius from 29 degrees Celsius as 9 minutes and 42 seconds.

The air conditioner 100 according to an embodiment of the disclosure may store the table shown in FIG. 4B, but the disclosure is not limited thereto. For example, as shown in FIG. 4A, when the increase/decrease of the indoor temperature is sensed through the sensor 110, the air conditioner 100 can acquire the power consumed and the time taken for the indoor temperature to increase/decrease by the unit temperature. It is needless to say that it is possible to generate, improve or update the table shown in FIG. 4B based on the obtained power consumption and the required time.

As another example, the air conditioner 100 may receive and store power consumption information and time information from a server (not shown). The air conditioner 100 can receive power consumption information and time information required to increase or decrease the indoor temperature according to the operation mode, the outdoor temperature, the room humidity, and the indoor space of the air conditioner 100 by the unit temperature from the server.

It is needless to say that the air conditioner 100 according to the disclosure may predict power consumption. For example, if the outdoor temperature is 29 degrees Celsius, the indoor temperature is 29 degrees Celsius, and the desired temperature is 24 degrees Celsius, the air conditioner 100 can predict the power consumption based on the following Equation 2.

570(Whr)=114(Whr/degree Celsius)*1(degree Celsius)+114(Whr/degree Celsius)*2(degrees Celsius)+114(Whr/degrees Celsius)*2(degrees Celsius) Equation 2

The air conditioner 100 according to an embodiment can predict 570 (Whr) as the power consumption, that is, 570 (Whr) as the power consumption when the indoor temperature reaches 24 degrees Celsius from 29 degrees Celsius.

The numbers corresponding to the power consumption information and time information shown in FIG. 4B are one embodiment, but the disclosure is not limited thereto. The air conditioner 100 may include a plurality of tables including power consumption information and time information corresponding to various criteria such as the size of the indoor space, the indoor humidity, the degree of lighting of the indoor space, the operation mode of the air conditioner 100, and so on. The power consumption information and the time information may be acquired by experiments and stored at the time of manufacturing the air conditioner 100, and may be received from the server. However, the disclosure is not limited to this, and it is needless to say that it may be acquired based on the sensed power consumption and time required during the operation of the air conditioner 100.

FIG. 5 is a view to describe information obtained by an air conditioner according to an embodiment of the disclosure.

Referring to FIG. 5, the air conditioner 100 according to another embodiment may sense various information in addition to the power consumption and required time as illustrated in FIG. 4A, and store sensed information as use history.

For example, the air conditioner 100 may additionally sense at least one of the indoor temperature, the indoor humidity, the information about the area where the air conditioner 100 is disposed, the outdoor temperature, the outdoor humidity, the current mode, the current time, and the difference between the indoor temperature and the desired temperature (indoor temperature-desired temperature).

Power consumption and required time to increase or decrease indoor temperature by unit temperature according to various variables such as indoor humidity, outdoor humidity, current mode (operation mode) of the air conditioner 100 can be different, in addition to the outdoor temperature and the indoor temperature. The air conditioner 100 according to an embodiment may sense various indoor environments such as an operation mode, humidity, and a size of a space and obtain power consumption and required time consumed by the air conditioner 100 so that the indoor temperature increases or decreases by unit temperature in the operation mode or sensed indoor environment.

The air conditioner 100 according to an embodiment can generate a plurality of tables corresponding to each of the operation mode and the indoor environment. The air conditioner 100 may predict the power consumption and time required for the indoor temperature to reach the desired temperature through the learned AI model based on the power consumption information and the time information included in the table corresponding to the operation mode and the indoor environment.

In particular, the air conditioner 100 according to an embodiment of the disclosure can store a usage history including an operation mode and a desired temperature of the air conditioner per indoor temperature sensed. The air conditioner 100 can acquire the user's preferred mode and the preferred temperature based on the use history and predict the power consumption and time required for the indoor temperature to reach the preferred temperature on the preferred mode.

Figure 6:
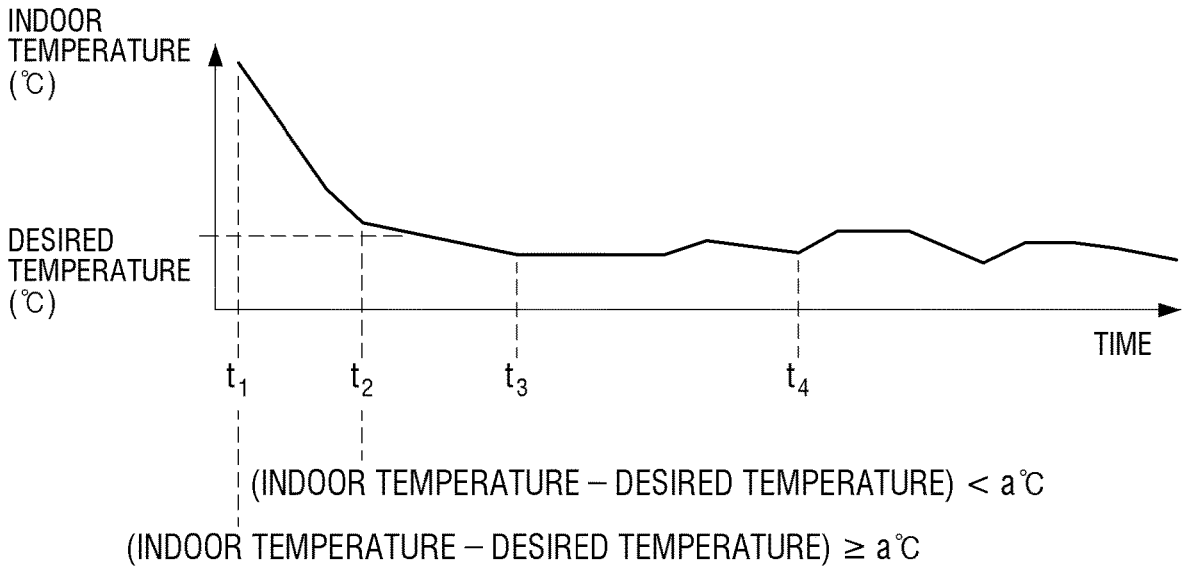
FIG. 6 is a view to describe an operation mode of an air conditioner according to an embodiment of the disclosure.

FIG. 6 is a view to describe an operation mode of an air conditioner according to an embodiment of the disclosure.

Referring to FIG. 6, the air conditioner 100 may set an operation mode of the air conditioner 100 according to the difference (indoor temperature−desired temperature) between the indoor temperature and the desired temperature.

For example, the air conditioner 100 may predict power consumption and time required for the indoor temperature to reach the desired temperature at t1, and provide predicted power consumption and time.

If the difference between the indoor temperature sensed at t1 and the desired temperature is equal to or greater than a preset value ((indoor temperature-desired temperature)≥a degrees Celsius), the air conditioner 100 according to the embodiment of the disclosure may set the air conditioner to the first mode, and predict the power consumption and time required for the indoor temperature to reach the desired temperature based on the air conditioning performance in the first mode. For example, when the difference between the indoor temperature and the desired temperature is large, the air conditioner 100 can perform cooling by setting an operation mode having a relatively excellent air conditioning performance among a plurality of operation modes. The better the air conditioning performance is, the higher the power consumption can be, but the advantage is that the time required for the indoor temperature to reach the desired temperature is reduced.

When the difference between the indoor temperature sensed at t2 and the desired temperature is less than a preset value ((indoor temperature-desired temperature)<a degrees Celsius), the air conditioner 100 according to the embodiment of the disclosure sets the air conditioner to the second mode, and predict the power consumption and time required for the indoor temperature to reach the desired temperature based on the air conditioning performance in the second mode. For example, when the difference between the indoor temperature and the desired temperature is not large, the air conditioner 100 may set a dehumidifying mode, a power saving mode, a no-wind mode, and the like. The air conditioner 100 can perform cooling by switching to a mode in which the indoor temperature is relatively increased while the time at which the indoor temperature reaches the desired temperature is relatively low.

The air conditioner 100 according to the embodiment of the disclosure can provide at least one of the cumulative power consumption and the cumulative use time through the display since the indoor temperature has reached the desired temperature at t3 and t4.

Figure 7:
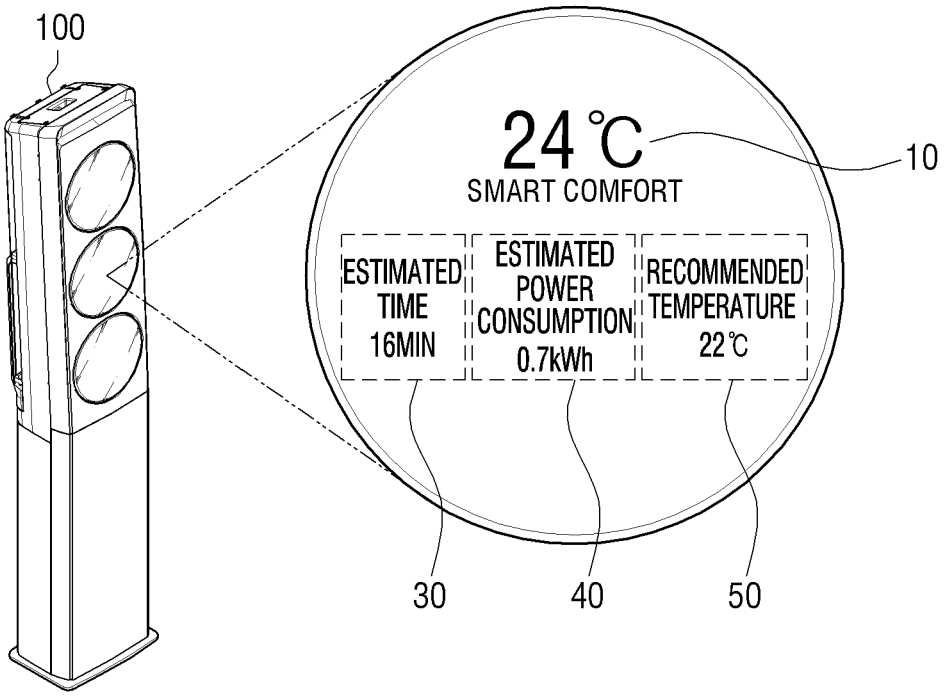
FIG. 7 is a view to describe recommended temperature of an air conditioner according to an embodiment of the disclosure.

FIG. 7 is a view to describe recommended temperature of an air conditioner according to an embodiment of the disclosure.

Referring to FIG. 7, the air conditioner 100 may acquire a preferred temperature based on use history. For example when the preferred temperature according to use history is 22 degrees Celsius, recommended temperature 50 of 22 degrees Celsius can be displayed.

The air conditioner 100 may estimate the power consumption and time required for the indoor temperature 10 which is 24 degrees Celsius to reach the recommended temperature 50 which is 22 degrees Celsius, and display the estimated time 30 and the estimated power consumption 40.

Figure 8:
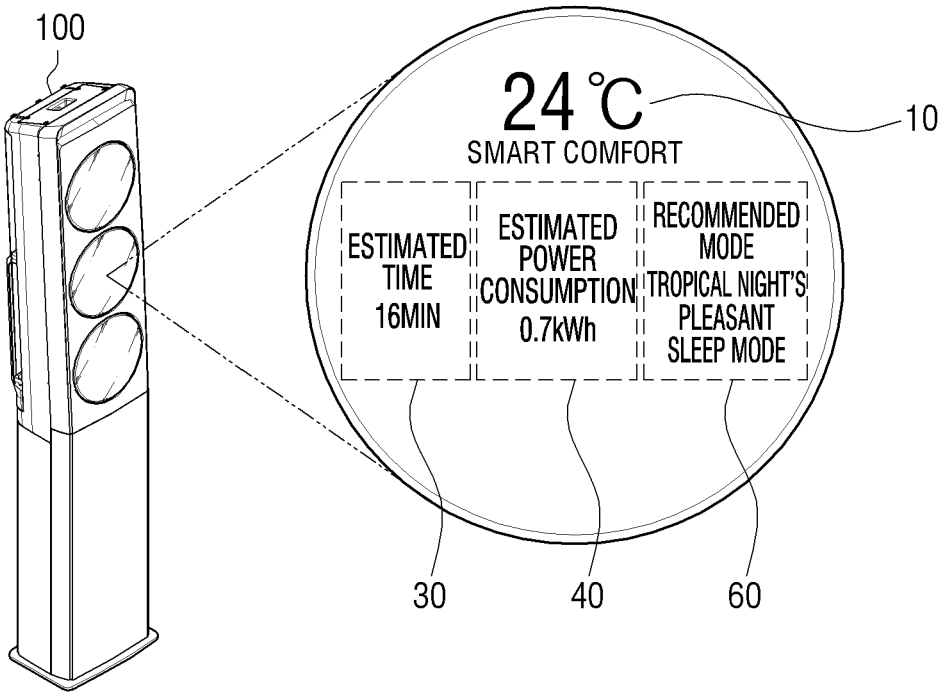
FIG. 8 is a view to describe a recommended mode of an air conditioner according to an embodiment of the disclosure.

FIG. 8 is a view to describe a recommended mode of an air conditioner according to an embodiment of the disclosure.

Referring to FIG. 8, the air conditioner 100 can acquire the preferred mode based on the use history. For example, if the preferred mode according to the use history is the "tropical night's pleasant sleep mode," the "tropical night's pleasant sleep mode" can be displayed in the recommended mode 60.

The air conditioner 100 may predict power consumption and time which are required until the indoor temperature 10 reaches the desired temperature in the recommended mode and display the estimated time 30 and the estimated power consumption 40.

The air conditioner 100 according to an embodiment can acquire the preferred mode and temperature at the current time based on the current time. For example, if "smart comfort" is in the preferred mode from 1:00 pm to 5:00 pm on the basis of the use history of the user and the current time is included from 1:00 pm to 5:00 pm, the air conditioner 100 can set "smart comport" to the operation mode.

As another example, when at least one of the current time, the external temperature, and the external humidity is within a predetermined range, the air conditioner 100 can be set to the mode optimized for the current time. For example, if the current time is 10:00 PM to 6:00 AM, "tropical night's pleasant sleep mode" can be set. As another example, if the external humidity is 70% or more, a "dehumidification mode" can be set.

The air conditioner 100 according to an embodiment of the disclosure can set an operation mode based on a difference between an indoor temperature and a desired temperature. For example, if the difference between the indoor temperature and the desired temperature is equal to or greater than a preset value, the air conditioner 100 is set to the first mode, and if the difference between the sensed indoor temperature and the desired temperature is less than a predetermined value, the air conditioner 100 can be set to the second mode.

Figure 9:
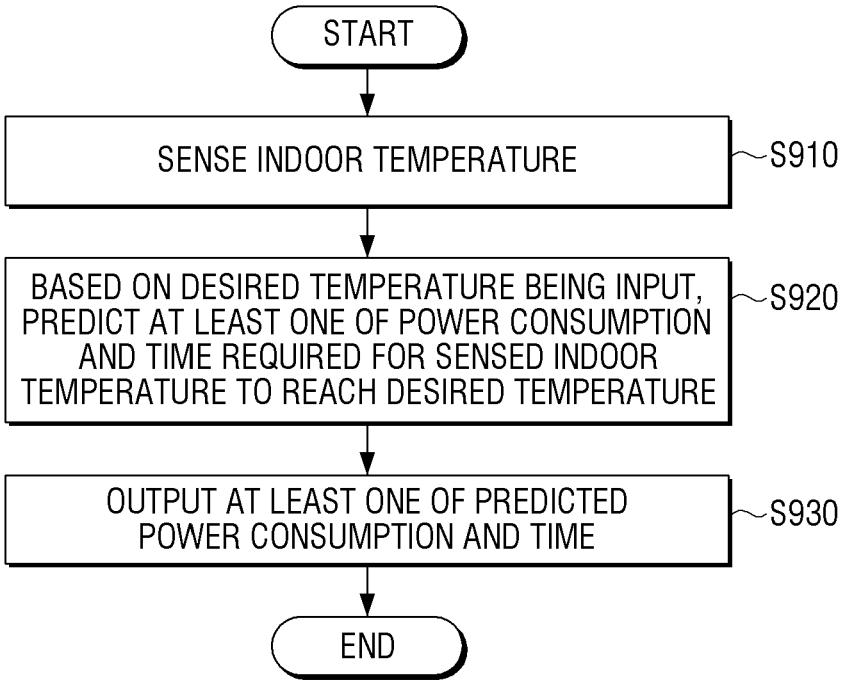
FIG. 9 is a flowchart to describe a controlling method of an air conditioner according to an embodiment of the disclosure.

FIG. 9 is a flowchart to describe a controlling method of an air conditioner according to an embodiment of the disclosure.

According to the control method of the air conditioner in which the power consumption information and the time information required to increase and decrease the indoor temperature by the unit temperature according to the outdoor temperature shown in FIG. 9 are stored, the indoor temperature is sensed in operation S910.

Then, when desired temperature is input, at least one of power consumption and time which are required so that the sensed indoor temperature to reach to the desired temperature is predicted in operation S920.

Then, at least one of the predicted power consumption and time is output in operation S930.

The control method according to an embodiment of the disclosure includes receiving information on the outdoor temperature of the area where the air conditioner is disposed, and the step of predicting S920 may include predicting at least one of power consumption and time required so as to reach the desired temperature based on the received outdoor temperature and the sensed indoor temperature.

The control method according to an embodiment of the disclosure includes the steps of acquiring the power consumed by the air conditioner and the required time when the sensed indoor temperature is increased or decreased by a predetermined unit temperature and the indoor temperature is increased or decreased by the unit temperature, and updating the stored information based on at least one of the obtained power consumption and the required time.

The control method according to an embodiment includes the steps of: predicting the indoor environment in which the air conditioner is disposed based on the obtained power consumption and the required time, obtaining and storing power consumption information and time information corresponding to the predicted indoor environment. Here, the indoor environment may include at least one of the size of the indoor space in which the air conditioner is disposed, the degree of lighting and the humidity.

According to another aspect of the disclosure, there is provided a control method which includes acquiring a power consumed by an air conditioner and a required time when a sensed indoor temperature is increased or decreased by a predetermined unit temperature, comparing at least one of the acquired power consumption and the required time with at least one of stored power consumption information and time information, and providing feedback according to the comparison result.

Here, the control method according to an embodiment may further include providing a guide to the indoor environment in which the air conditioner is located if the comparison result exceeds a predetermined error range.

The air conditioner according to an embodiment of the disclosure may store a usage history including at least one of an operation mode and a desired temperature of the air conditioner per unit indoor temperature sensed, and control method according to an embodiment further includes acquiring the preferred mode and the preferred temperature based on the use history, and the operation of predicting in S920 may include predicting at least one of the power consumption and time required for the sensed indoor temperature to reach the preferred temperature on the preferred mode.

Here, the acquiring may include acquiring the user's preferred mode and the preferred temperature currently preferred at current time based on the current time.

Further, the operation of predicting may include predicting at least one of power consumption and time through the AI model, and the AI model is based on at least one of the power consumption information, the time information, and the indoor environment in which the air conditioner is disposed. The indoor environment may include at least one of the size of the indoor space in which the air conditioner is disposed, the degree of lighting and the humidity.

The control method according to an embodiment may include setting the air conditioner to a mode optimized for the current time if the current time is within a predetermined time range.

Figure 10:
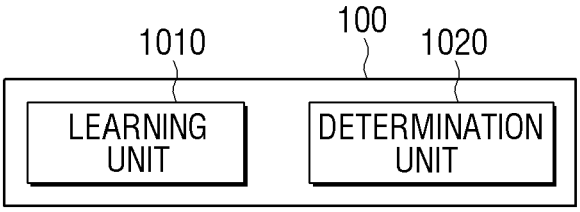
FIG. 10 is a block diagram illustrating a configuration of an air conditioner to learn and use an artificial intelligence (AI) model according to an embodiment of the disclosure.

FIG. 10 is a block diagram illustrating a configuration of an air conditioner to learn and use an AI model according to an embodiment of the disclosure.

Referring to FIG. 10, the air conditioner 100 may include at least one of a learning unit 1010 and a determination unit 1020.

The learning unit 1010 can generate or learn an AI model having a criterion for predicting the power consumption and time of the air conditioner 100 using the learning data. The learning unit 1010 can generate an AI model having a determination criterion using the collected learning data.

For example, the learning unit 1010 may learn to predict at least one of power consumption and time corresponding to desired temperature with the required power consumption and time information required to increase or decrease indoor temperature by unit temperature according to outdoor temperature as learning data. If the sensed indoor temperature is increased or decreased by a predetermined unit temperature, the learning unit 1010 may acquire the power consumed by the air conditioner 100 and the time required for the indoor temperature to be increased or decreased by the unit temperature, and generate, learn, or update the AI model on the basis of at least one of the power consumed by the air conditioner 100 and time required to increase and decrease the indoor temperature.

The determination unit 1020 may use predetermined data as input data of the learned AI model and predict at least one of power consumption and time.

For example, the determination unit 1020 may use at least one of the outdoor temperature, the indoor temperature, and the desired temperature as input data of the learned AI model and predict (or estimate, infer) at least one of power consumption and time required so that the indoor temperature reaches the desired temperature.

As an embodiment of the disclosure, the learning unit 1010 and the determination unit 1020 may be included in the air conditioner 100, but this is merely and can be mounted inside an external server.

At least a part of the learning unit 1010 and at least a part of the determination unit 1020 according to an embodiment may be implemented in a software module or in the form of at least one hardware chip and mounted on the air conditioner 100. For example, at least one of the learning unit 1010 and the determination unit 1020 may be fabricated in the form of a dedicated hardware chip for AI, or a general-purpose processor (e.g., a CPU or an application processor) or a graphics-only processor (e.g., GPU) and may be mounted on the various electronic devices described above. At this time, the dedicated hardware chip for AI is a special processor specialized in probability calculation, and it has a higher parallel processing performance than the general processor, so that it is possible to quickly process the AI field such as machine learning. When the learning unit 1010 and the determination unit 1020 are implemented by a software module (or a program module including an instruction), the software module may be stored in a computer-readable non-transitory media. In this case, the software module may be provided by an operating system (OS) or by a predetermined application. Alternatively, some of the software modules may be provided by an OS, and some of the software modules may be provided by some applications.

Figure 11A:
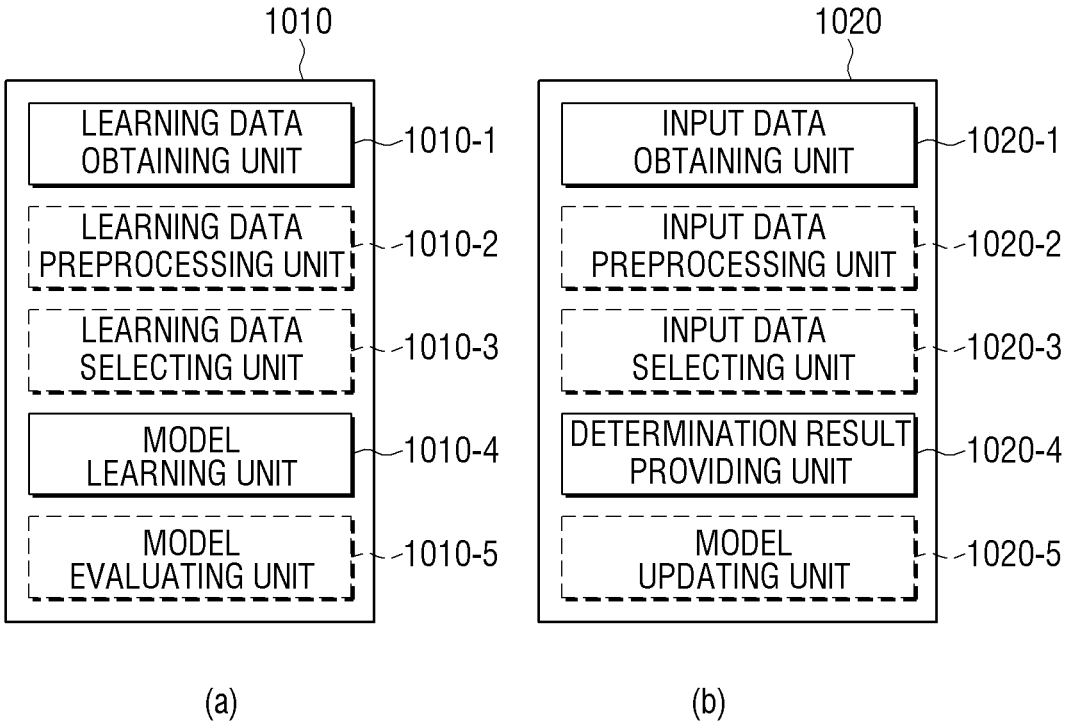
FIG. 11A is a block diagram of a learning unit and a determination unit according to various embodiments of the disclosure.

FIG. 11A is a block diagram of a learning unit and a determination unit according to an embodiment of the disclosure.

Referring to (a) of FIG. 11A, the learning unit 1010 according to some embodiments may include a learning data obtaining unit 1010-1 and a model learning unit 1010-4. The learning unit 1010 may further include at least one of a learning data preprocessing unit 1010-2, a learning data selecting unit 1010-3, and a model evaluating unit 1010-5, selectively.

The learning data obtaining unit 1010-1 can acquire learning data necessary for an AI model for predicting at least one of power consumption and time required. In the embodiment of the disclosure, the learning data obtaining unit 1010-1 can acquire, as learning data, the power consumed by the air conditioner 100 and the required time, etc., as the indoor temperature is increased or decreased by the unit temperature. Also, the learning data obtaining unit 1010-1 can acquire, as learning data, a usage history or the like for acquiring the user's preferred mode, preference temperature, and the like. The learning data may be data collected or tested by the learning unit 1010 or the manufacturer of the learning unit 1010.

The model learning unit 1010-4 can use the learning data so that the AI model has a criterion for predicting at least one of the power consumption and the required time. For example, the model learning unit 1010-4 can make an AI model learn through supervised learning using at least a part of the learning data as a reference for predicting at least one of the power consumption and the required time. Alternatively, the model learning unit 1010-4 may make the AI model learn through unsupervised learning which finds a criterion to predict at least one of power consumption and required time through self-learning using learning data without supervised learning. Further, the model learning unit 1010-4 can make the AI model learn through reinforcement learning using, for example, feedback as to whether the determination result based on learning is correct. Also, the model learning unit 1010-4 can make an AI model learn using, for example, a learning algorithm including an error back-propagation method or a gradient descent.

The model learning unit 1010-4 may learn the selection criteria regarding which learning data is to be used to predict at least one of power consumption and required time using the input data.

The model learning unit 1010-4 can determine an AI model having a great relation between the input learning data and the basic learning data as an AI model to be learned, when a plurality of AI models exist in advance. In this case, the basic learning data may be pre-classified according to the data type, and the AI model may be pre-built for each data type. For example, the basic learning data may be pre-classified by various criteria such as an area where the learning data is generated, a time at which the learning data is generated, a size of the learning data, a genre of the learning data, a creator of the learning data, and types of an object within learning data, and so on.

When the AI model is learned, the model learning unit 1010-4 can store the learned AI model. In this case, the model learning unit 1010-4 can store the learned AI model in the memory of the external server. Alternatively, the model learning unit 1010-4 may store the learned AI model in a memory of a server or an electronic device connected to an external server through a wired or wireless network.

The learning unit 1010 may further include the learning data preprocessing unit 1010-2 and the learning data selecting unit 1010-3 for improving the determination result of the AI model or saving resources or time required for generation of the AI model.

The learning data preprocessing unit 1010-2 can preprocess the acquired data so that the acquired data can be used for learning to predict at least one of the power consumption and the required time. The learning data preprocessing unit 1010-2 can process the acquired data into a predetermined format so that the model learning unit 1010-4 can use the acquired data to predict at least one of the power consumption and the required time.

The learning data selecting unit 1010-3 can select data acquired by the learning data obtaining unit 1010-1 or data necessary for learning from data preprocessed by the learning data preprocessing unit 1010-2. The selected learning data may be provided to the model learning unit 1010-4. The learning data selecting unit 1010-3 can select learning data necessary for learning from the acquired or preprocessed data in accordance with a predetermined selection criterion. The learning data selecting unit 1010-3 can also select learning data according to a predetermined selection criterion by learning by the model learning unit 1010-4.

The learning unit 1010, in order to improve a determination result of the AI model, may further include a model evaluating unit 1010-5.

The model evaluating unit 1010-5 may input evaluation data to the AI model, and when the determination result output from the evaluation data does not satisfy the predetermined criterion, may make the model learning unit 1010-4 learn again. In this case, the evaluation data may be pre-defined data for evaluating the AI model.

For example, the model evaluating unit 1010-5 may determine, from among the determination results of the learned AI model about the evaluation data, that, when the number w or ratio of evaluation data of which determination result is not correct exceeds a preset threshold value, that predetermined criterion is not satisfied.

When there are a plurality of learned AI models, the model evaluating unit 1010-5 may evaluate whether each of the learned AI models satisfies a predetermined criterion, and determine a model satisfying the predetermined criteria as the final AI model. In this case, when there are a plurality of models satisfying a predetermined criterion, the model evaluating unit 1010-5 can determine any one or a predetermined number of models preset in descending order of the evaluation score as a final AI model.

Referring to (b) of FIG. 11A, the determination unit 1020 according to some embodiments may include the input data obtaining unit 1020-1 and the determination result providing unit 1020-4.

The determination unit 1020 may further include at least one of the input data preprocessing unit 1020-2, the input data selecting unit 1020-3, and the model updating unit 1020-5, selectively.

The input data obtaining unit 1020-1 can obtain data necessary for predicting at least one of power consumption and time required. As a result of the determination, the determination result providing unit 1020-4 can estimate at least one of the power consumption and the time required by applying the input data obtained by the input data obtaining unit 1020-1 to the learned AI model as an input value. As a result of the determination, the determination result providing unit 1020-4 may apply the data selected by the input data preprocessing unit 1020-2 or the input data selecting unit 1020-3, which will be described later, to the AI model to obtain the determination result.

In an embodiment, as a result of the determination, the determination result providing unit 1020-4 may apply the learned AI model to the outdoor temperature, the indoor temperature, and the desired temperature obtained by the input data obtaining unit—1020-1, and predict at least one of the power consumption and the time required so that the indoor temperature reaches the desired temperature.

The determination unit 1020 may further include an input data preprocessing unit 1020-2 and an input data selecting unit 1020-3 in order to improve the determination result of the AI model or to save resources or time for providing a determination result.

The input data preprocessing unit 1020-2 can preprocess acquired data so that the acquired data can be used for predicting at least one of the power consumption and the required time. As a result of the determination, the input data preprocessing unit 1020-2 may processes the acquired data in a predefined format so as to use data obtained for predicting at least one of the power consumption and the time required for the determination result providing unit 1020-4.

The input data selecting unit 1020-3 can select data required for providing a response from the data acquired by the input data obtaining unit 1020-1 or the data preprocessed by the input data preprocessing unit 1020-2. The selected data may be provided to the determination result providing unit 1020-4 as a determination result. The input data selection unit 1020-3 can select some or all of the acquired or preprocessed data according to a predetermined selection criterion for providing a response. The input data selecting unit 1020-3 can also select data according to a predetermined selection criterion by learning by the model learning unit 1010-4.

The model updating unit 1020-5 can control the AI model to be updated based on the evaluation of the determination result provided by the determination result providing unit 1020-4 as a determination result. For example, the model updating unit 1020-5 may provide the model learning unit 1010-4 with the determination result provided by the providing unit 1020-4 as a determination result, so that the model learning unit 1010-4 may be asked to learn or update the AI model further. In particular, the model updating unit 1020-5 can re-learn the AI model based on feedback information according to user input.

Figure 11B:
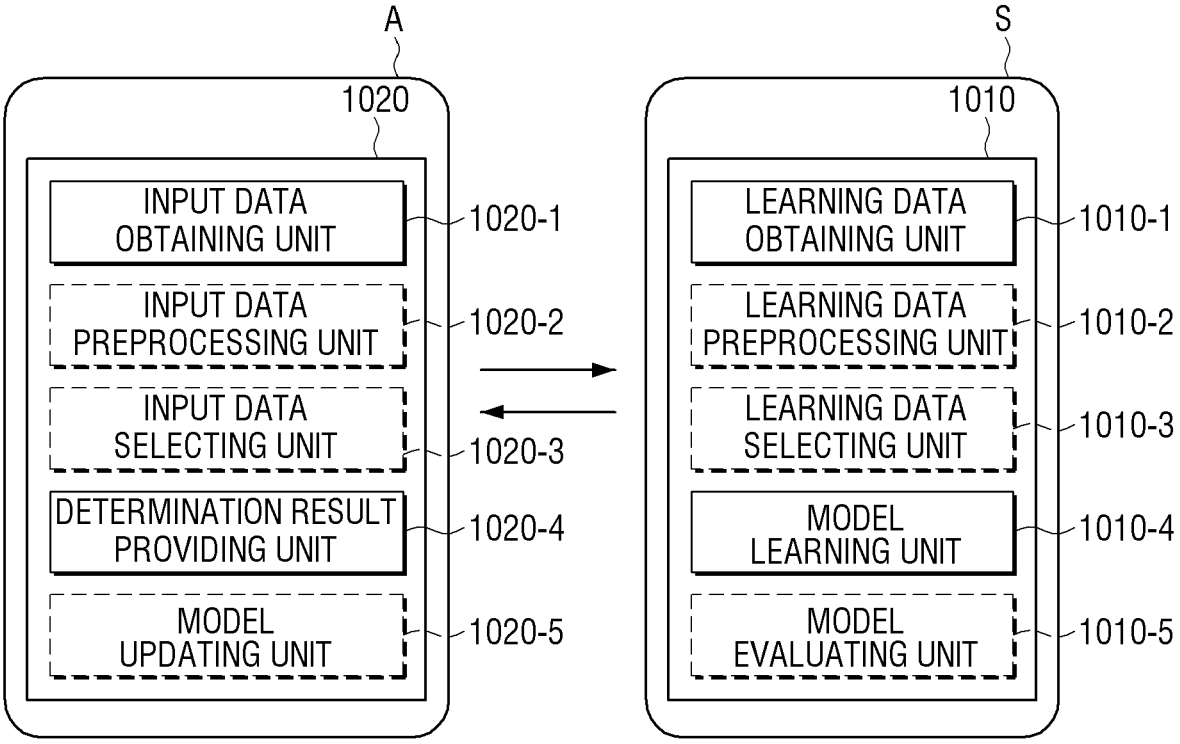
FIG. 11B is a view to illustrate an example of learning and determining data by interlocking an air conditioner and an external server according to an embodiment of the disclosure.

FIG. 11B is a view to illustrate an example of learning and determining data by interlocking an air conditioner and an external server according to an embodiment of the disclosure.

Referring to FIG. 11B, the external server S can learn a criterion for predicting at least one of the power consumption and the required time, and the air conditioner 100 can provide at least one of the predicted power consumption and required time based on a learning result by the server (S).

In this case, the model learning unit 1010-4 of the server S can perform the function of the learning unit 1010 shown in FIG. 10. That is, the model learning unit 1010-4 of the server S may learn a criterion regarding which power information or time information is to be used to predict at least one of power consumption and required time, and how to predict at least one of power consumption and required time using the information.

The determination result providing unit 102-4 of the air conditioner 100 may apply the data selected by the input data selecting unit 1020-3 to the AI model generated by the server (S) to predict at least one of power consumption and required time. Alternatively, the determination result providing unit 1020-4 of the air conditioner 100 may receive an AI model generated by the server from the server, and predict at least one of power consumption and required time using the received AI model.

Meanwhile, the various embodiments described above can be implemented in a recording medium that can be read by a computer or a similar device using software, hardware, or a combination thereof. In some cases, the embodiments described herein may be implemented by the processor itself. According to a software implementation, embodiments such as the procedures and functions described herein may be implemented in separate software modules. Each of the software modules may perform one or more of the functions and operations described herein.

Meanwhile, computer instructions for performing the processing operations according to various embodiments of the disclosure described above may be stored in a non-transitory computer-readable medium. Computer instructions stored in such non-volatile computer-readable media may cause a particular device to perform processing operations according to various embodiments described above when executed by a processor.

Non-volatile computer readable medium means a medium that stores data for a short period of time such as a register, a cache, a memory, etc., but semi-permanently stores data and can be read by a device. Specific examples of non-transitory computer readable media include compact disc (CD), digital versatile disc (DVD), hard disk, Blu-ray disk, universal serial bus (USB), memory card, read only memory (ROM), etc.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An air conditioner comprising:

a display;

a storage;

a sensor configured to sense an indoor temperature; and a processor configured to:

store information, in storage, including at least one of power consumption information or time information which are required to increase or decrease the indoor temperature by a unit of temperature according to an outdoor temperature, predict by using a model learned based on a learning algorithm, in response to a desired temperature being input, at least one of a first power consumption or a first required time for the indoor temperature to reach the desired temperature based on the information stored in the storage, wherein the model is trained based on an indoor environment comprising a size and a degree of lighting of an indoor space in which the air conditioner is disposed and trained based on at least one of the power consumption information or the time information, provide at least one of the first power consumption or the first required time through the display, and based on a generated comparison result exceeding a predetermined error range, provide a guide on the indoor environment in which the air conditioner is positioned, the guide indicating one or more suggestions, the one or more suggestions indicating changes to the indoor environment, wherein the guide comprises guiding to check whether outside air, exceeding a specified amount, enters the indoor environment and guiding to check whether outside light, exceeding a specified amount, enters the indoor environment.

2. The air conditioner of claim 1, further comprising:

a communication circuitry, wherein the processor is further configured to:

receive, through the communication circuitry, outdoor temperature information corresponding to the outdoor temperature an area in which the air conditioner is disposed, and predict at least one of the first power consumption or the first required time based on the received outdoor temperature information or the indoor temperature.

3. The air conditioner of claim 1, wherein the processor is further configured to:

based on the indoor temperature being increased or decreased by a preset unit of temperature, measure at least one of a second power consumption or a second required time which are consumed by the air conditioner for the indoor temperature to increase or decrease by the unit of temperature, and update the stored information based on at least one of the measured second power consumption or the measured second required time.

4. The air conditioner of claim 3, wherein the processor is further configured to:

predict the indoor environment in which the air conditioner is disposed based on at least one of the second power consumption or the second required time, obtain at least one of power consumption information or time information corresponding to the predicted indoor environment, and store at least one of the obtained power consumption information or the obtained time information in the storage, and wherein the indoor environment comprises a humidity of the indoor space in which the air conditioner is disposed.

5. The air conditioner of claim 1, wherein the processor is further configured to generate the comparison result, the generation of the comparison result comprising:

based on the indoor temperature being increased or decreased by a predetermined unit of temperature, obtaining a second power consumption or a second required time which are consumed by the air conditioner for the indoor temperature to increase or decrease by the unit of temperature, and comparing at least one of the second power consumption or the second required time with at least one of the power consumption information or the time information.

6. The air conditioner of claim 1, wherein the storage stores a use history including at least one of an operation mode of the air conditioner according to the indoor temperature or the desired temperature, and wherein the processor is further configured to:

obtain a user dependent mode and a user dependent temperature of a user based on the use history, and predict at least one of a second power consumption or a second required time for the sensed indoor temperature to reach the user dependent temperature in the user dependent mode.

7. The air conditioner of claim 6, wherein the processor, based on a current time, obtains the user dependent mode and the indoor temperature corresponding to the current time included in the use history.

8. The air conditioner of claim 1, wherein the model is re-trained based on obtained information when at least one of power consumption information or time information corresponding to the indoor environment are obtained.

9. The air conditioner of claim 1, wherein the processor is further configured to, based on the indoor temperature reaching the desired temperature, provide accumulated power consumption information through the display.

* * * * *